United States Patent [19]

Jones

[11] Patent Number: 4,493,172

[45] Date of Patent: Jan. 15, 1985

[54] CONNECTOR SYSTEM

[76] Inventor: Brian D. Jones, 6 Yorkton Rise, Mangere Bridge, Auckland, New Zealand

[21] Appl. No.: 408,899

[22] Filed: Aug. 17, 1982

[51] Int. Cl.[3] ..... A47G 5/00

[52] U.S. Cl. ..... 52/220; 52/282; 52/738; 52/239; 52/726

[58] Field of Search ..... 52/282, 238, 239, 738, 52/36, 220, 726; 160/135

[56] References Cited

U.S. PATENT DOCUMENTS

| | | | |
|---|---|---|---|
| 1,221,205 | 4/1917 | Moore | 52/239 |
| 3,049,195 | 8/1962 | Leat | 52/282 |
| 3,333,379 | 8/1967 | Harris | 52/364 |
| 3,762,116 | 10/1973 | Anderson | 52/282 |
| 3,841,042 | 10/1974 | Siegal | 52/738 |
| 3,987,838 | 10/1976 | LaGue | 52/239 |
| 4,021,973 | 5/1977 | Hegg | 52/239 |
| 4,388,786 | 6/1983 | Gassler | 52/282 |

*Primary Examiner*—John E. Murtagh
*Assistant Examiner*—Kathryn Ford
*Attorney, Agent, or Firm*—Holman & Stern

[57] ABSTRACT

Office partition panels are mounted on cylindrical connector posts. The posts have tongues or grooves running along parts or all of their length which match with corresponding grooves or tongues or locking pieces readily affixed to or integral with the edges of the panels to hold the panels securely in place.

8 Claims, 9 Drawing Figures

CONNECTOR SYSTEM

FIELD OF THE INVENTION

This invention relates to a connector system which has been designed particularly for use in connecting panels together to provide partitions or screens. These partitions or screens are of particular use in offices, for example, where it is often desired to subdivide a large floor area into smaller bays and offices. However, the connector system can be used for connecting articles other than panels and can be used in the manufacture of a knock-down type furniture. It is an object of the present invention to provide a connector system whereby articles can be inter-connected either without the use of tools or with the use of tools, such as screwdrivers which are commonly available and in its preferred forms the system can be used by unskilled persons.

SUMMARY OF THE INVENTION

The present invention consists in a combination of interconnecting extruded members comprising a connecting member having a periphery which is substantially circular in cross section and having a plurality of integral connecting means formed in or on said periphery and an engaging member having an engagement means, one of the connecting means or the engaging means comprising a locking groove running lengthwise along one member and the other of the connecting means or the engaging means comprising a locking tongue running lengthwise along the other member, the groove and the tongue inter-locking to prevent withdrawal expect by sliding the members relative to each other in a direction parallel to their lengths.

BRIEF DESCRIPTION OF THE DRAWINGS

The invention will now be described in detail with reference to the accompanying drawings wherein.

DESCRIPTION OF THE PREFERRED EMBODIMENT

Figure 1:
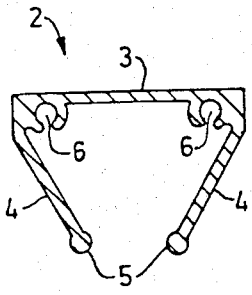
FIG. 1 shows a cross sectional view through a preferred engaging member.
Figure 2:
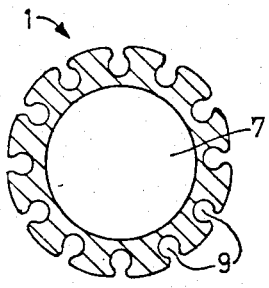
FIG. 2 shows a cross sectional view through the preferred connecting member.

According to the preferred form of the invention a connector system comprises two basic components these being a connecting member 1, the preferred cross sectional shape of which is shown in FIG. 2, and an engaging member 2 the preferred cross sectional shape of which is illustrated in FIG. 1. These are extruded from a suitable material which is preferably aluminium or an aluminium alloy but which could be some other metal or a plastics material instead and the extrusions are cut to length as required.

The connecting member has a plurality of connecting means and the engaging member has at least one engaging means. One of the connecting means or the engaging means comprises a locking groove running lengthwise along the appropriate member and the other connecting means or the engaging means comprises a locking tongue running lengthwise along the other member. By sliding the two members relative to each other in a direction parallel to their lengths, a groove and a tongue can be made to inter-lock to prevent withdrawal except by reversing the sliding motion. It is a feature of the invention that the one or more engaging means of the engaging member can be inter-locked with any one or more of the connecting means of the connecting member, this feature providing the invention with considerable versatility which is of advantage in the preferred application to partitioning. In the preferred form of the invention the connecting means of the connecting member comprises the locking groove, there being a plurality of these locking grooves about the periphery of the connecting member, the grooves running lengthwise along the connecting member, and in this case the engaging means of the engaging member comprises one or more locking tongues running lengthwise along the engaging member. However, in an alternative form of the invention the connecting means of the connecting member comprises the locking tongue, there being a plurality of these tongues about the periphery of the connecting member, the tongues running lengthwise along the connecting member, and in this particular case the engaging means of the engaging member comprise one or more locking grooves running lengthwise along the engaging member.

Figure 6:
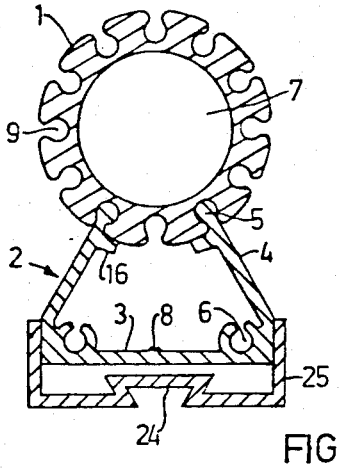
FIG. 6 is a cross sectional view showing an alternative preferred engaging member inter-connected with a connecting member.

A preferred engaging member, as illustrated in FIGS. 1 and 6, is substantially channel shaped, having a base 3 and two projecting and inwardly converging arms or walls 4 which do not touch but which have expanded free ends providing the locking tongues 5, these being substantially circular in cross sectional shape and designed to interlock with two of the locking grooves of the connecting member. Each of the walls of the engaging member makes an angle of 60° with respect to the base. Adjacent the intersection of the walls 4 with the base 3 there is a thickened region designed to reinforce the engaging member to prevent fracture at this point. The engaging member is provided with at least one securing portion which has a hollow interior which is substantially circular in cross section over at least the major part of its circumference. Preferably two securing portions are provided, one in each of the thickened regions, by substantially circular securing grooves 6. The securing grooves provide sites for fastenings such as self-tapping screws if it is desired to attach an article, such as an end cap, to an end of an engaging member. For the usual attachment of an engaging member to an article, holes (not shown) are drilled through the base 3 for fastenings such as screws. To enable the holes to be drilled accurately in the centre of the base a drilling groove 8 is provided on the interior. It is preferable that the drilling groove is formed between two small ribs raised from the base, as illustrated in FIG. 6, so that the provision of the drilling groove does not result in any weakening of the base of the engaging member.

The periphery of the preferred connecting member (FIG. 2) is substantially circular in cross section. The preferred connecting member has a hollow interior 7 which is also preferably circular in cross section. A plurality of locking grooves 9 are uniformly and symmetrically spaced about the periphery of the connecting member, the grooves being of substantially circular cross section. Each of the locking grooves is capable of receiving in an inter-locking arrangement one of the locking tongues of the engaging member, but because of the shape of the locking tongues and the locking grooves, which have narrowed neck openings, the connecting member and the engaging member can only be inter-connected by sliding the members relative to each other in a direction parallel to their lengths. For the preferred engaging member described the connecting member has twelve locking grooves, these being located at 30° angular dispositions about the periphery of the connecting member. The locking grooves are also suitable for use as locating sites for fastenings such as screws, in the same manner as the securing grooves 6 of the engaging member, this feature enabling an end cap or plate or the like to be attached to the end of a connecting member.

When the engaging member is inter-connected with a connecting member the tongues of the engaging member occupy two of the locking grooves of the connecting member, these grooves, because of the spacing and the angular arrangement of the walls of the engaging member and the spacing and the angular disposition of the locking grooves of the connecting member, being separated by another of the locking grooves as is best illustrated in FIG. 6. The remaining locking grooves of the connecting member are available for inter-locking with the tongues of a second engaging member, this engaging member being capable of being positioned in any one of a number of angular dispositions relative to that engaging member first attached. Normally the engaging member would first be attached to an article such as a panel 12 before being inter-connected with the connecting member. Thus, by use of this invention two panels can be connected together by means of an engaging member attached to each and a connecting member and the panels can be arranged at 180° relative to each other, that is in a straight line, or instead the panels can be arranged at 90° or 120° or 150° relative to each other. More than two panels can be similarly connected if desired, for example, four panels can be connected to the one connecting member these panels being arranged at 90° with respect to each adjacent panel. Hence use of this invention provides a useful and versatile connector system for partitioning. Because the engaging member has two locking tongues, each of which inter-locks with the connecting member, a relatively rigid connection is provided. The rigidity of the connection can be improved by providing a flange 16 on each of the walls of the engaging member adjacent the locking tongue, as illustrated in FIG. 6, which when the engaging member and connecting member are inter-connected butts against the periphery of the connecting member. In modifications of the invention the engaging member can have only one locking tongue, or alternatively can have more than two locking tongues. Similarly, the connecting member can have a greater or lesser number of locking grooves and the engaging member can be suitably shaped so that any two or more articles can be connected in a greater or lesser number of angular dispositions relative to each other than is the case with that preferred form of the invention so far described.

For joining two panels together each panel 12 has an engaging member attached to an edge. The connecting member used can have a length substantially equal to the length of an engaging member and an end plate or cap 15 having a diameter substantially equal to the diameter of the connecting member can be attached to each end of the connecting member to prevent the connecting member and engaging members from being detached unless the cap is first removed. However, the preferred connecting member, because of its shape, is a relatively expensive extrusion and to reduce the length of connecting member required an elongated intermediate member 10 is provided which allows the engaging member to interconnect with short lengths of connecting member which are mounted on the intermediate member which passes through the hollow interiors of each of the lengths of connecting member. The intermediate member is preferably an extrusion having a size and shape which makes it less expensive to extrude than the connecting member. The periphery of the intermediate member conforms in shape to that of the hollow interior of the connecting member and is therefore preferably circular in cross section.

Figure 3:
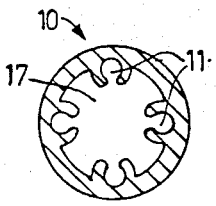
FIG. 3 shows a cross sectional view through an intermediate member.

The preferred cross sectional shape of the intermediate member is illustrated in FIG. 3. This intermediate member has a hollow interior 17 and is provided on its interior with at least one securing portion itself having a hollow interior which is circular in cross section over at least a major part of its circumference. The securing portion 11 comprises two projecting lips extending from the interior of the hollow along the length of the intermediate member so that it has a similar shape to that of a securing groove 6 of an engaging member and can perform a similar function. There are preferably four securing portions 11 equally spaced about the internal periphery of the intermediate member.

Figure 4:
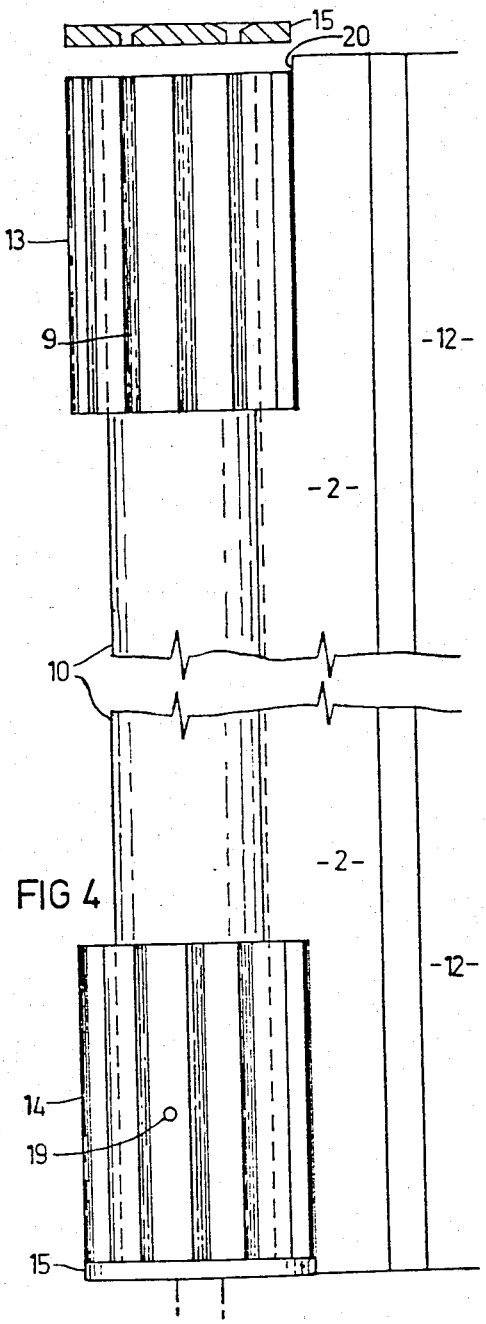
FIG. 4 is a side elevation showing an assembly of a panel having an engaging member attached at one edge this engaging member inter-connected with two short lengths of connecting member which are mounted on a length of the intermediate member.

The use of an intermediate member 10 in conjunction with two short lengths 13 and 14 of connecting member is illustrated in FIG. 4. A single length of engaging member is attached to an edge of a panel 12 and is interconnected with the two lengths of connecting member located at the upper and lower ends of the intermediate member. The length of the intermediate member is substantially equal to or is slightly less than the length of the engaging member. In the assembly of the members connecting member 14 is secured to the bottom end of the intermediate member by a fastening such as a rivet, screw, or pin 19. A cap 15 is attached to the connecting member and the lower ends of the tongues of the engaging member rest on this cap which blocks the ends of the locking grooves. Because the connecting member 14 is relatively short in length only a short sliding movement is required to inter-connect the lower end of the engaging member with this connecting member. The connecting member 13 is then slid onto the intermediate and engaging members at their upper ends, this connecting member 13 also having a cap 15 attached to retain the connecting member at the upper end of the assembly. Therefore, to dismantle any partitioning connecting member 13 can simply be slid from the intermediate and engaging members and the engaging member slid from the connecting member 14. The caps 15 can be provided with screw holes which align with the securing portions of the intermediate member into which self tapping screws can be screwed to attach the caps to the connecting members. The top and bottom ends of the engaging member can be cropped sufficiently as at 20 to allow the caps to sit flush with the ends of the engaging member. Panels of different heights can be connected together using the same system. Where a shorter panel is being used with a longer panel, a third short length of connecting member can be mounted on the intermediate member, being positioned at the top end of the shorter panel and held in position by a pin or screw attached to the intermediate member and passing either through or below this third connecting member.

However, if the connecting member and the engaging member which are to be inter-connected are both relatively long the engaging member can be provided with locking tongues at only intervals along its length and the connecting member can be provided with locking grooves also along only a portion of its length, the construction and arrangement being such that the two members can be engaged or disengaged by relative lengthwise or axial sliding movement over only a portion of their lengths.

Figure 5:
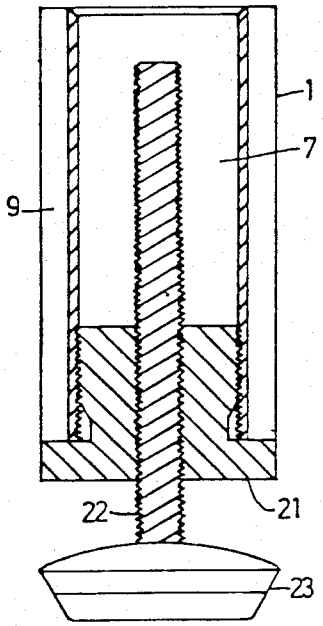
FIG. 5 is a cross sectional view of a length of the connecting member having an adjustable pressure pad.

In a modification of the invention the hollow interior of a connecting member can be threaded at one or both ends or can be threaded along its length. In this case a male threaded member can be screwed into the threaded hollow interior of the connecting member. It is preferred that the male threaded member is an end closing device 21 or cap as illustrated in FIG. 5. This provides an alternative method of attaching end caps to that method illustrated in FIG. 4, though the end caps could instead be secured in position by an adhesive. The end closing device or cap can have a threaded hole passing through it in an axial direction and a threaded shaft 22 which screws into the threaded hole, the shaft bearing a pressure pad 23 at its outer end, the construction and arrangement being such that the distance between the pressure pad and the connecting member to which the end closing device is attached can be varied. This is of value in adjusting the height of partitions for example, in which case the pressure pad functions as a foot.

Figure 7:
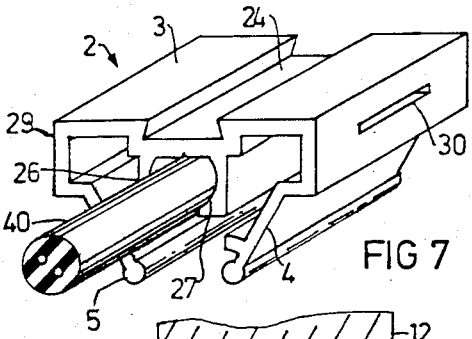
FIG. 7 shows a perspective view of an alternative form of engaging member.

The above describes the preferred form of the invention and indicates some possible modifications but other modifications can be made without departing from the scope of the invention as defined in the claims. Some of these possible modifications are illustrated in FIGS. 6 to 9 of the accompanying drawings. For example, as illustrated in FIG. 7, the base 3 of the substantially channel shaped engaging member is provided with an outwardly opening dovetail slot 24 which runs lengthwise along the engaging member. The dovetail slot can be formed in the base of the engaging member as shown in FIG. 7 or alternatively can be formed, as illustrated in FIG. 6, in a separate channel shaped member 25 which is attachable to the engaging member by any suitable means. The dovetail slot can be used to connect the engaging member to another article by means of a dovetail shaped connector or the slot can be used for glazing, receiving the edge of a sheet of glass together with glazing beads for example.

In FIG. 7 the engaging member has a dovetail slot 24 formed in the base 3 of the engaging member and on the interior of the base there is a pair of projecting lips 26 defining a captive groove 27 which can be used for locating an electrical cable 40. The walls of the engaging member of FIG. 7 each have a side portion 29 extending at right angles from the base before the walls converge, the side portions having apertures formed in them. These apertures can be holes or slots 30 and can be used for the attachment of brackets or other articles if required. The view through the apertures from one side of the engaging member to the other is blocked by the lips 26 of the captive groove.

Figure 8:
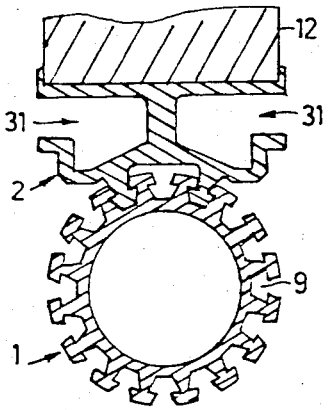
FIG. 8 is a cross sectioal view illustrating alternative forms of connecting member.

With reference to FIG. 8 the engaging member can be provided with portions which define two opposed slots 31 and these can also be used to receive the edges of panels or sheets of material if desired. FIG. 8 also illustrates an alternative form of connecting member, the locking grooves being substantially T shaped in cross section.

Figure 9:
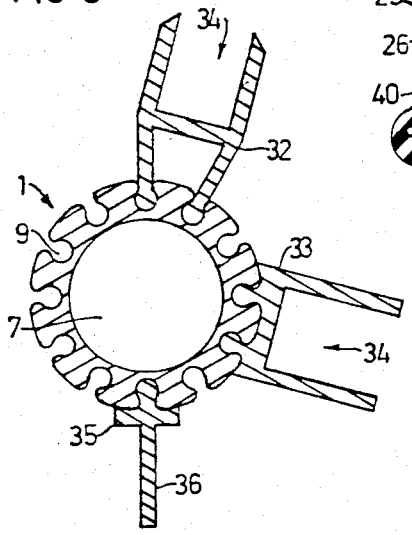
FIg. 9 is a cross sectional view showing the preferred form of connecting member with further alternative forms of the engaging member.

In FIG. 9 three modifications of the engaging member are shown inter-connected with the preferred form of connecting member. Engaging members 32 and 33 each have an elongated channel shaped portion 34 comprising a base and two walls projecting at right angles from the base. The channel shaped portion, in use, receives the edge of a panel to which the engaging member is attached. On the opposite side of the base there are one or more locking tongues, the engaging members 32 and 33 each having two locking tongues. The spacing and angular disposition of these locking tongues are such that these interlock with two adjacent locking grooves of the connecting member. Also illustrated in FIG. 9 is an engaging member 35 which has a base and a central flange 36 or bayonet projecting at right angles from the base, and on the opposite side of the base there is a single locking tongue though a greater number of locking tongues can be provided if desired. The flange 36, in use, can be located in a slot provided in the edge of a planar member or panel to which the engaging member is to be attached.

These various modifications described above add to the versatility of the connector system. A further feature of the connector system, where the intermediate member is used, is that it is possible for panels or other articles which are inter-connected to be pivotal relative to each other, the connecting members, when not actually attached to the intermediate member, functioning as a hinge.

We claim:

1. A combination of inter-connecting extruded members comprising:

short lengths of connecting members each having a hollow interior, a periphery which is substantially circular in cross-section and a plurality of integral connecting means formed on said periphery;

an engaging member having engaging means;

each connecting means comprising a locking groove running lengthwise along said connecting member, and each engaging means comprising a locking tongue running lengthwise along said engaging member, said groove and tongue inter-locking to prevent withdrawal except by sliding said members relative to each other in a direction parallel to their lengths; and an extruded elongate intermediate member passing through the hollows of each of the lengths of connecting member and on which said lengths of connecting member are mounted, said engaging member inter-connecting with each of the lengths of connecting member, said intermediate member having a hollow interior provided with at least one securing portion, each securing portion comprising two projecting lips extending from the interior of the hollow of the intermediate member along the length of the intermediate member and which is circular in cross section over at least a major part of its circumference.

2. A combination of inter-connecting extruded members comprising:

a connecting member having a periphery which is substantially circular in cross section and a plurality of integral locking grooves about and formed on said periphery, grooves running lengthwise along said connecting member; and an engaging member having two locking tongues running lengthwise along the engaging member and interlocking with two of said locking grooves to prevent withdrawal except by sliding said members relative to each other in a direction parallel to their lengths, said engaging member being substantially channel shaped having a base and two projecting and inwardly converging walls which do not touch, the walls having the locking tongues at their free ends, and a pair of projecting lips on the interior of said base defining a captive groove receiving an electrical cable.

3. A combination as claimed in claim 2 wherein said connecting member has a hollow interior.

4. A combination as claimed in claim 3 wherein said hollow interior is threaded.

5. A combination as claimed in claim 4 wherein a male threaded member which screws into the hollow interior has a threaded hole passing though it in an axial direction, and the combination includes a threaded shaft which screws into the threaded hole, the shaft bearing a pressure pad at an end, the constructions and arrangement being such that the distance between the pressure pad and the connecting member can be varied.

6. A combination as claimed in claim 2 wherein the base of the substantially channel shaped engaging member is provided with an outwardly opening dovetail slot running lengthwise along the engaging member.

7. A combination as claimed in claim 2 wherein the walls of the substantially channel shaped engaging member have side portions extending at right angles from the base before converging, the side portions having apertures in them.

8. A combination as claimed in claim 2 wherein said engaging member is provided with said locking tongues at only intervals along its length and wherein the connecting member is provided with said locking grooves along only a portion of its length, the construction and arrangement being such that the two members can be engaged or disengaged by relative lengthwise or axial sliding movement over only a portion of their lengths.

* * * * *